United States Patent [19]

Bärmann

[11] 4,377,278

[45] Mar. 22, 1983

[54] APPARATUS FOR EQUALIZING PRESSURE IN SHAFT FURNACES

[75] Inventor: Hans Bärmann, Contwig, Fed. Rep. of Germany

[73] Assignee: Mannesmann Aktiengesellschaft, Dusseldorf, Fed. Rep. of Germany

[21] Appl. No.: 260,208

[22] Filed: May 4, 1981

[51] Int. Cl.[3] ..... C21B 7/16; C21B 7/18

[52] U.S. Cl. ..... 266/197; 266/176

[58] Field of Search ..... 266/197, 176

[56] References Cited

U.S. PATENT DOCUMENTS 3,929,240 12/1975 Legille ..... 266/176

*Primary Examiner*—P. D. Rosenberg

*Attorney, Agent, or Firm*—Mandeville and Schweitzer

[57] ABSTRACT

An apparatus for equalizing the pressure in shaft furnaces which are operated at a pressure in excess of atmospheric pressure. At least one storage bin is connected to the furnace chamber, although isolated from the atmosphere and the furnace chamber by sealing valves. A gas pipeline serves to selectively supply or exhaust gas to the storage bin to equalize pressure. In one embodiment of the invention, two storage bins are interconnected by a gas pipeline and appropriate valves for equalizing pressure between the storage bins.

8 Claims, 1 Drawing Figure

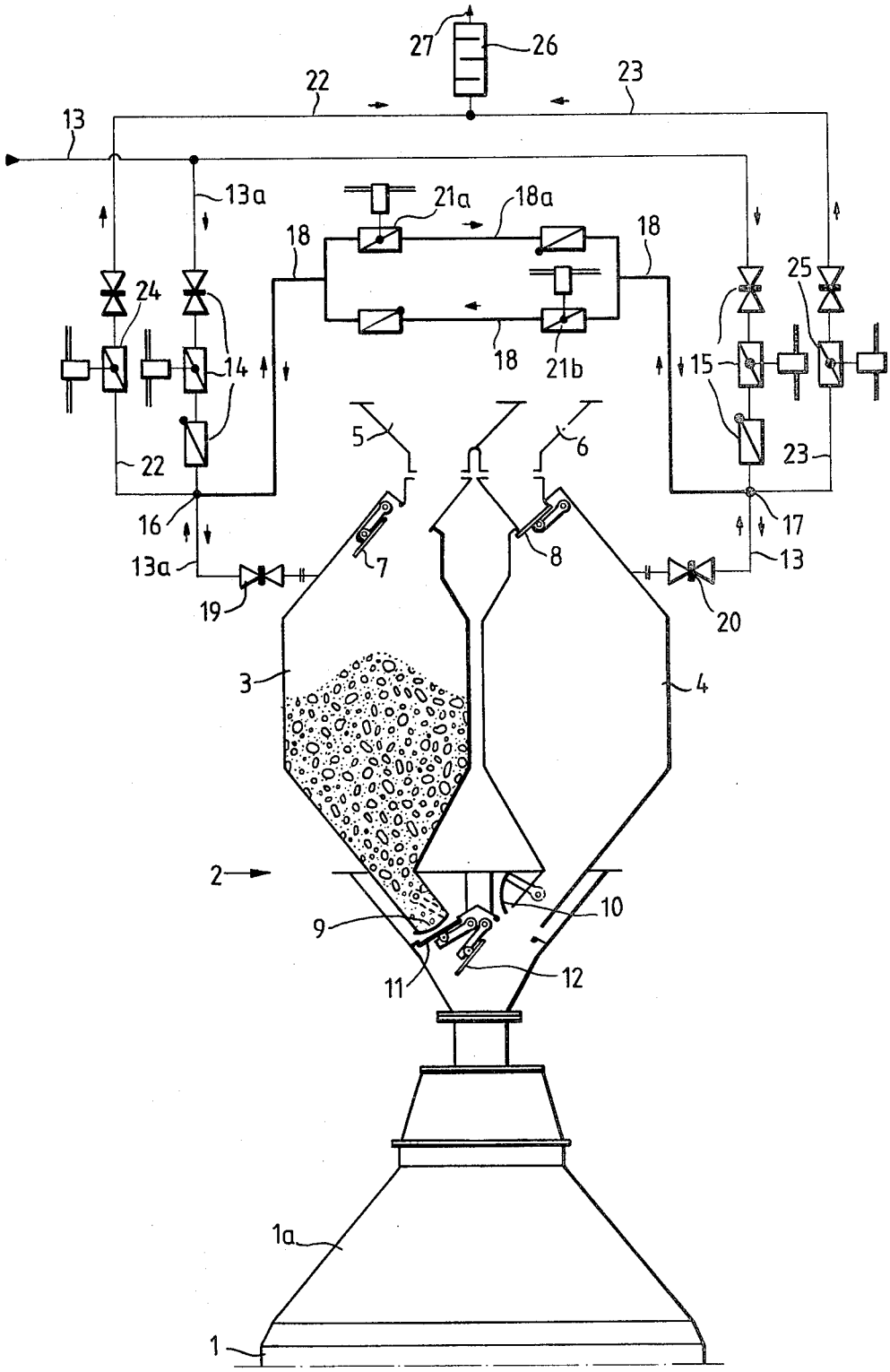
27
26
22
23
13
13a
21a
18a
18
18
24
25
14
18
21b
15
5
6
22
23
16
17
13a
7
8
13
19
20
3
4
2
9
10
11
12
1a
1

APPARATUS FOR EQUALIZING PRESSURE IN SHAFT FURNACES

BACKGROUND OF THE INVENTION

The invention relates to an apparatus for equalizing the pressure in shaft furnaces operated at a pressure in excess of atmospheric pressure, particularly large blast-furnaces, with at least one storage bin connected to the furnace chamber in the charge direction, with a charge entrance-valve sealed against the atmosphere and a charge exit-valve sealed against the furnace chamber assigned to said storage bin, and with a gas pipeline connected to the storage bin which may be switched alternately to supply pure gas or to exhaust gas into the atmosphere.

DESCRIPTION OF THE PRIOR ART

Pressure equalizers of this type serve to balance furnace pressure and atmospheric pressure because, with the increase of the gas pressure beyond atmospheric pressure in the furnace corresponding to the surface pressure of the valve lids, forces must be applied corresponding to the summary force from the furnace pressure corresponding to the pressure-charged surface. It would be uneconomical to apply these forces and, above all, it would require special energy-producing apparati. A further reason for employing pressure equalizers of this type is the exhaust of furnace gases which, in the case of large differences in pressure, would release considerable amounts of dust-carrying gases at high speed from the furnace-top distributor. Dust flows of this type wear the structural elements down.

Conventional pressure equalizers are subject to the problem of cost when charging semi-purified furnace-top distributor gas in the place of pure furnace-top distributor gas as pressure-equalizing gas (DE-AS No. 20 16 205) or, also, to the problem of the large differences in pressure between the lock chambers where the sealing points are subjected to considerable wear during higher gas speeds through the friction of the ceramic or metal particles contained in the crude gas (DE-AS No. 14 33 323). A further proposal (DE-AS No. 15 83 177) is subject to the same problem. That proposal is directed towards the elimination of the upper furnace-top bell in a two-bell system of a blast-furnace top-closure, in which a further gas-sealing plate is arranged in the place of the upper top bell. The pressure equalization for opening the gas-sealing plate occurs vertically between the furnace chamber and the upper charge surge tank. In that case, the furnace-chamber pressure, built up in the upper charge surge tank, is released into the open, in each instance via exhaust lines and exhaust valves, separately arranged above each charge surge tank, in order to open the additional gas-sealing plate which is a sealant against the free atmosphere.

Large blast furnaces of the described structure cause problems regarding the dust, gas, and sound emissions which have recently become subject to legal regulations. Accordingly, dusts, noxious gases and sounds either must not occur or must be removed or minimized at their source (professional journal (Steel and Iron), No. 96 (1976) No. 4 of Feb. 26, 1976, page 144). This poses the problem for the designer or the process technician to take into consideration accessibility, clarity of layout and operational safety of the plant while avoiding dusts, noxious gases and sounds. It has been noted that it is especially difficult to lower the sound level since sound can only be muffled through bulk. This would necessitate packing the plant into thick and, therefore, heat-insolating cases, which would not be advantageous with respect to heat exhaust.

In one case which is known (VDI-News No. 38 of Sept. 21, 1979, page 11) interference noises were beamed into a residential area from an adjacent shaft-furnace charge point, at approximately 50 m height. According to the article, sound-pressure levels of 54 to 55 dB are not permissible. A permissible maximum value in sound emission is 50 dB. In the known case, the sound-emission problem was solved by a sound-muffling and sound-insulating cover at the sound-intensive charge area of the shaft furnace. This cover is a shield having, on its outside, a zinc-plated trapezoidal sheet-metal cover for the absorption of wind forces. This concept requires, furthermore, a boomless, sandwich steel-metal cover behind the trapezoidal metal-sheet cover for the required insulation. The acoustical effect was insulated by a frequency-coordinated air-sound absorption layer of metal fiber. Subsequently, the sound levels were measured to be 45 dB. The decrease in sound corresponded to approximately 45 to 50% of the initial noise level.

While according to the prior art mentioned, the level of noise in a large furnace could only be lowered through sound-insulating measures, it is the object of the present invention to fight sound emissions at their source of origin.

SUMMARY OF THE INVENTION

This problem is solved with the help of at least one additional gas chamber vessel in addition to the storage bin, said gas chamber vessel having at least one shut-off valve and by the storage bin and gas chamber vessel being connected to each other by means of pressure-equalizing pipelines which may be switched in counter direction. Consequently, this solution causes lower gas pressure so that, in releasing the excess-pressure gases into the atmosphere, it creates lower levels of gas speeds and, therefore, lower levels of interference sounds. A further advantage is apparent in the release of lower quantities of dust gas so that the environment is subject to less dust pollution. In this case, the vessel serving as gas chamber vessel may be combined with a special dust-separating apparatus. It should be especially emphasized, however, that for the pressure equalization of the storage bin a lower quantity of pure gas is required than was previously the case. The present invention, therefore, causes savings in pure gas with each pressure-equalization process and, thereby, increases the economy of the pressure-equalizing method.

The point of departure, regarding large blast furnaces in operation, should be assumed to be an interior pressure of above 0.1 bar, said pressure possibly reaching furnace-top distributor pressures of 1.5 bar and more. It is, therefore, possible, according to the present invention, to obtain a reduction of pressure of 50% and more in relation to the storage bin during maximum pressure of 1.5 bar and equal gas volume of the storage bin and the gas chamber vessel so that the point of departure now need only be furnace-top distributor pressures of equal to or less than 0.75 bar.

This result must be obtained when, as is normally provided, the gas chamber vessel, according to the further development of the present invention, consists of a further storage bin assigned to the storage bin of the same design. This creates the special effect that the corresponding furnace chamber pressure, to be released from the storage bin from which the charge is emptied into the furnace chamber, is also brought down to a considerably lower level so that less dust-charged gas is released from both storage bins into the atmosphere at a lower noise level.

In further development of the present invention, storage bins assigned to each other have a considerably enlarged volume relative to their filling volume. In large blast furnaces, for example, storage bins of this type have a filling volume of 30 to 60 $m^3$. They may, however, be equipped easily for an additional gas volume. In this case it should be borne in mind that the filling volume itself represents only a gross volume which the filling materials fill out only with a net volume. The gas volume is, therefore, already stored in the filling volume for the filling materials.

The invention may, however, also be used in a manner in which a special vessel is provided for the pressure-equalization gas, said vessel not fulfilling the function of a storage bin. A design of that type is carried out, according to the present invention, in such a manner that a gas chamber vessel, assigned to a storage bin, is arranged below the closure of the furnace-top distributor. It is, therefore, especially advantageous to arrange the gas chamber vessel at the ground level or, in case of less weight, halfway up the furnace, up to the height of the furnace-top distributor. A design of that type is particularly made possible by choosing pressure-equalizing pipelines which extend between the storage bin and the gas chamber vessel.

A particularly simple solution was found in that in the pressure-equalizing pipeline and in a branched-off bypass-pipeline valve pairs, which may be switched, are provided for respective opposing gas flows.

Sound emissions can be eliminated completely, with the convenient help of the lower gas pressure, by connecting the storage bin or, if applicable, storage bins, or, possibly, gas chamber vessels to a sound muffler which has, at the side of the exit, an opening for the exhaust of the gases into the open.

BRIEF DESCRIPTION OF THE DRAWING

An exemplary embodiment of the present invention is presented in the illustration and described more fully below. The only FIGURE of the illustration shows a diagrammatic cross section of the upper part of the large blast furnace which is equipped with the pressure-equalizing apparatus according to the invention.

DETAILED DESCRIPTION OF THE INVENTION

A blast furnace 1 is represented, in operation in the high-pressure mode, as a shaft furnace. The exhaust pipes of the furnace-top distributor, not being in direct connection with the present invention, are not shown in the drawing. The furance-top distributor closure 2 is above the furnace head 1*a*. Said closure consists essentially of the storage bins 3 and 4, with the below-described sealing mechanisms. A filling funnel 5 or, if applicable 6, is respectively arranged at the entrance of each storage bin 3 or, if applicable 4. The storage bins 3 and 4 may be locked against the free atmosphere by means of customary sealing lids 7 or, if applicable, 8, with their sealing points outside the path of the charge material. Charge-material holding lids 9 or, if applicable, 10 are at the exit of each storage bin 3, 4, and sealing lids 11 or, if applicable, 12 are provided to them.

Purified exhaust gas from the furnace-top distributor of a conventional dust-removing apparatus, not further illustrated, is fed through the pipeline 13 into the storage bin 4, and through the branched pipeline 13*a* into the storage bin 3, in order to equalize the pressure. Shut-off valves 14 or, if applicable, 15 are in the respective pipeline sections in order to switch the supply of pure gas on or off. The pressure-equalizing pipeline 18 is connected to the branch pipelines 16 or, if applicable, 17, and said pressure-equalizing pipeline connects, according to the fundamental idea of the present invention, the two storage bins 3 and 4 to each other. Each of the storage bins 3 and 4 may be separated from the entire pipeline system by means of the shut-off valves 19 or, if applicable, 20. The gas flow from the furnace-top distributor moving in the pipeline 13, in the branch pipeline 13*a* or, if applicable, in the pressure-equalizing pipeline 18 is guided, in opposing flow direction, through the bypass-pipeline 18*a*. The shut-off valves 21*a* and 21*b* serve to switch the gas flow in the opposing direction. The gas from the furnace-top distributor, which is to be released, is guided from the branch pipelines 16 or, if applicable, 17 via the pressure-release pipelines 22 or, if applicable, 23, in which pipelines the shut-off valves 24 or, if applicable, 25 are also switched on, to the sound muffler 26 and from there into the open 27.

The invention works in the following cycle:

With sealing lid 7 open and sealing lid 11 or, if applicable, charge-material holding-shutter 9 closed, the storage bin 3 is partially filled with charge material (fuel such as, for example, coke, smelts such as, for example, pig-iron charge). Subsequently, the sealing lid 7 is closed.

Subsequently, the inner room of the storage bin 3 is still under atmospheric pressure. Previously, the charge material content of the storage bin 4 was emptied into the furnace 1, with the sealing lid 8 closed and the sealing lid 12 or, if applicable, charge-material holding lid 10 open. In this phase, the gas pressure of the furnace 1 prevails in storage bin 4.

At this time, the furnace-top distributor gas overflows, via the pressure-equalizing pipeline 18, from the inner chamber of the furnace into the storage bin 3, which process occurs by the shut-off valves 19, 20, 21*b* being opened, with the shut-off valves 14, 15 or, if applicable, 24, 25 closed. This not only lowers the gas pressure considerably, but also the dust content of the gases from the furnace-top distributor. The charge material in the storage bin 3 absorbs the dust to a certain extent, and the elimination of said dust is the more advantageous the longer the gas from the furnace-top distributor lingers above the charge material of, if applicable, in the gaps between the charge material. Only a lesser quantity of pure gas is now required to open the sealing lid 11, on the side of the furnace chamber and the charge-material holding lid 9, said pure gas being fed, for complete pressure equalization, into the storage bin 3 via the branch pipeline 13*a*. The pure gas is administered through the branch pipeline 13*a* subsequent to closing the shut-off valve 21*b*, and subsequent to opening the shut-off valve 14, until the separately measured furnace chamber inner compression is reached. The cycle thus described is re-initiated with the analogous steps for the storage bin 4, by opening the sealing lid 11 and the charge-material holding lid 9, and by releasing the charge material from the storage bin 3 into the furnace 1.

I claim:

1. An apparatus for use in connection with metallurgical shaft furnaces which operate at pressures in excess of atmospheric pressure, comprising:

(a) a metallurgical blast furnace having a furnace top with a furnace chamber located therebelow;

(b) at least one charge material storage bin connected to and located above said furnace chamber;

(c) said storage bins being sealed from the atmosphere by a charge material inlet seal;

(d) said storage bins being sealed from said furnace chamber by a storage bin exit seal;

(e) a gas supplying conduit connected to said storage bins for selectively supplying pure gas to said storage bins or for exhausting gas from said storage bins into the open atmosphere;

(f) at least one gas chamber vessel;

(g) a gas pressure equalizing means serving to connect said gas chamber vessels to said storage bins; and (h) said gas pressure equalizing means having a two-way gas direction switching means for selectively equalizing gaseous pressure in said storage bins and said gas chamber vessels.

2. An apparatus as claimed in claim 1, wherein:

(a) said gas chamber vessels comprise additional charge material storage bins.

3. An apparatus as claimed in claim 1, wherein:

(a) said storage bins have a considerably larger volume than their charge material holding volume.

4. An apparatus as claimed in claim 1, wherein:

(a) said gas chamber vessels are located below said furnace top of said blast furnace.

5. An apparatus as claimed in claim 1, wherein:

(a) said gas pressure equalizing means comprises at least two gas conduits, having selectively switchable valves such that gas can flow in either direction in said gas conduits between said storage bins and said gas chamber vessels.

6. An apparatus as claimed in claim 1, wherein:

(a) said gas pressure equalizing means comprises a first gas conduit having a selectively switchable valve for allowing gas flow in either direction between said storage bins and said gas chamber vessels; and (b) a bypass gas conduit branching off, in parallel, from said first gas conduit.

7. An apparatus as claimed in claim 1, wherein:

(a) at least one of said storage bins is connected to a sound muffling means; and (b) said sound muffling means opens to the atmosphere.

8. An apparatus as claimed in claim 1, wherein:

(a) at least one of said gas chamber vessels is connected to a sound muffling means; and (b) said sound muffling means opens to the atmosphere.

* * * * *